US005355797A

United States Patent [19]

Tielrooy

[11] Patent Number: 5,355,797

[45] Date of Patent: Oct. 18, 1994

[54] DEVICE FOR PRINTING OBJECTS COMPRISING MEANS FOR BRINGING THE IMAGES OF A NUMBER OF PRINTING PLATES IN REGISTER AND METHOD APPLIED WITH THE DEVICE

[75] Inventor: Robert W. Tielrooy, Amstelveen, Netherlands

[73] Assignee: Van Dam Machine, B.V., Amsterdam, Netherlands

[21] Appl. No.: 996,826

[22] Filed: Dec. 28, 1992

[51] Int. Cl.[5] ..... B41F 13/16; B41F 5/22

[52] U.S. Cl. ..... 101/177; 101/DIG. 36

[58] Field of Search ..... 101/DIG. 36, 216, 178, 101/177, 485, 486, 217, 218; 33/614, 617, 618, 620

[56] References Cited

U.S. PATENT DOCUMENTS 5,132,911 7/1992 Leader, Jr. ..... 101/DIG. 36

FOREIGN PATENT DOCUMENTS 089015 3/1982 European Pat. Off. .
277704 6/1912 Fed. Rep. of Germany .
8802756 6/1990 Netherlands ..... 101/DIG. 36
9002578 11/1990 Netherlands .

*Primary Examiner*—J. Reed Fisher
*Attorney, Agent, or Firm*—Mason, Fenwick & Lawrence

[57] ABSTRACT

A device for printing objects which has an offset cylinder rotatably supported by a frame and a plurality of plate cylinders arranged around the offset cylinder. The offset cylinder is adapted to be secured in a plurality of positions, each of the positions corresponding to a position of a plate cylinder. Each plate cylinder has a printing plate and each of the printing plates has a first marking located thereon in predetermined positional relationship with an image on the printing plate. A detecting member is mounted on the offset cylinder for detecting a positional relationship of the first marking relative to the detecting means.

6 Claims, 1 Drawing Sheet

DEVICE FOR PRINTING OBJECTS COMPRISING MEANS FOR BRINGING THE IMAGES OF A NUMBER OF PRINTING PLATES IN REGISTER AND METHOD APPLIED WITH THE DEVICE

First, the invention relates to a device for printing objects, comprising an offset cylinder rotatably supported by a framework with rubber cloth fitted thereon; a number of plate cylinders arranged around the offset cylinder, a printing plate being fixable on each of the plate cylinders; an inking apparatus near each plate cylinder for applying ink on the printing plates and transferring the ink on to the rubber cloth during operation of the device, in which the images on the printing plates can be brought in register by adjusting each plate cylinder in axial and radial direction in relation to the drive shaft of the relevant plate cylinder.

With the known devices, after a best possible adjustment of each plate cylinder, a number of objects are printed for checking the adjustment of the plate cylinders. By means of the results obtained, the necessary corrections in the position of the plate cylinders can be performed. Then, again a number of objects are printed for the purpose of checking. If necessary, this proces is repeated until one is sure that all plate cylinders are in the right position.

It will be obvious that such an adjustment is time-consuming and that in many cases, a number of printed objects have to be thrown away, since they do not meet the requirements. When, at normal operation, one uses an automatic discharge system, checked objects can not be received again in this system and will be removed as waste.

The invention intends to remove these problems and to that end provides for that means are present for securing the offset cylinder in a certain position in relation to each of the plate cylinders to be checked, that each printing plate has been provided with a marking, which, on each printing plate is situated at the same location in relation to the image on the printing plate and that at a certain location on the offset cylinder, a detecting member such as a video camera can be fixed for determining the position which said marking takes up in relation to the detecting member.

Since the detecting member, which for the sake of simplicity will hereinafter be indicated as a video camera, is mounted in a fixed position on the offset cylinder and remains present thereon during checking of all plate cylinders, one only has to see to it that the offset cylinder always takes up a certain position in relation to the plate cylinder to be checked in order to be able to bring the printing plate mounted on the related plate cylinder in the correct position in relation to the offset cylinder.

Through this, the time required for bringing all plate cylinders in the right position in relation to each other and in relation to the offset cylinder is considerably shortened and the amount of drop out of printed objects is considerably reduced.

According to a preferred embodiment of the invention, the means for securing the offset cylinder in relation to a plate cylinder can be in the shape of a number of bores provided in the offset cylinder, one for each plate cylinder, and a pin that can be stuck into one of the bores through a single bore provided in the framework.

Naturally, great accuracy must be practised on providing the bores in the offset cylinder. However, this is no problem, since high requirements of accuracy must be met with the manufacture of such devices.

With regard to the mounting of the video camera on the offset cylinder, there are no particularly high requirements to be met, since on adjusting the various plate cylinders the video camera can remain mounted on the offset cylinder. Because of that, in adjusting all plate cylinders one uses the same arrangement of the video camera in relation to the plate cylinder concerned.

In particular, the video camera will have been provided with a reticle or a system of cross hairs in the focus of an eye piece of a camera, which, on adjusting a printing plate must coincide with an adjustment cross provided on the printing plate.

By the fact that the reticles concerned are reproduced in an enlarged state on a video monitor, one can obtain an accurate adjustment of the printing plate.

Since in most cases, the printing plate will be situated in such a position, that light can not fall directly on to it, it can be provided for, that a lamp for illuminating a marking provided on the printing plate has been mounted near the video camera.

Due to the fact that the lamp is located near the video camera, it need only be adjusted in relation to the video camera once.

When it would further be desirable to check whether the longitudinal axis of the printing plate is accurately located in a plane running square to the axis of the cylinder, the printing plate can be provided with an additional marking at a radial distance from said marking and the framework can be provided with an additional bore.

Further, the invention also relates to the method for applying the device, which method is characterized by the following steps:

a) providing a marking, as in the shape of a cross, on each printing plate;

b) mounting each printing plate on one of the plate cylinders;

c) bringing the offset cylinder in a certain position in relation to a plate cylinder;

d) switching on the video camera and the monitor coupled therewith for detecting the marking of the printing plate; and e) bringing the marking of the printing plate and the marking provided in the video camera to coincide by adjustment of the plate cylinder.

BRIEF DESCRIPTION OF THE DRAWING

The invention is further explained by way of an embodiment, illustrated in the drawing, in which.

DESCRIPTION OF THE PREFERRED EMBODIMENT

Figure 1:
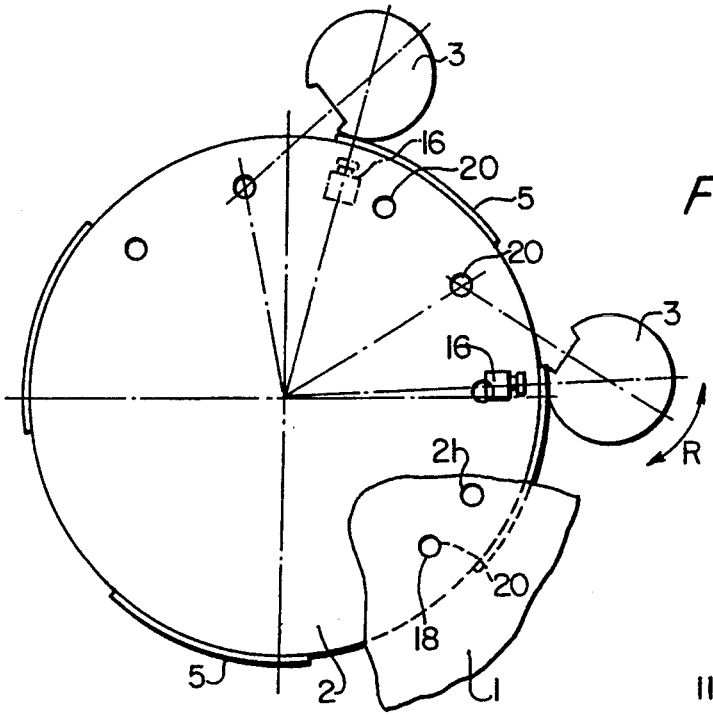
FIG. 1 diagrammatically shows a side view of a part of a device according to the present invention.
Figure 2:
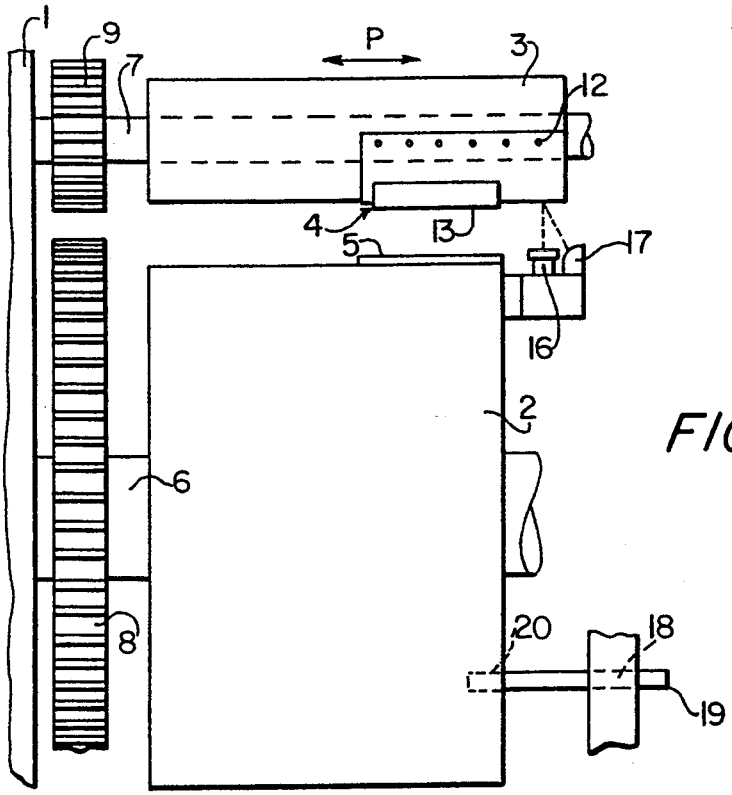
FIG. 2 diagrammatically shows an end view of the device according to FIG. 1.

The FIGS. 1 and 2 show only some parts of a device for printing objects. The device comprises a framework 1 for supporting an offset cylinder 2 and a number of plate cylinders 3, each having been provided with a printing plate 4. In FIG. 1, only two of the total amount of six plate cylinders present have been indicated and in FIG. 2 only one cylinder 3 has been indicated, to wit at some distance from the offset cylinder 2, on behalf of clarity. On the offset cylinder 2 there is a cloth 5 for each printing cylinder 3.

As appears from FIG. 2, the offset cylinder 2 and the plate cylinder 3 are supported by shafts 6 and 7 respectively, on which gear wheels 8, 9 respectively have been mounted for common drive by driving means not further indicated. In general, the gear wheels 8 and 9 will have an oblique toothing.

A plate cylinder 3 has been made such, that it is movable in relation to the shaft 7 in axial direction, as indicated by the arrow P in fig- 2, and in radial direction as well, as indicated by the arrow R in FIG. 1. The means for making these movements possible are known per se and are therefore not further described.

Figure 3:
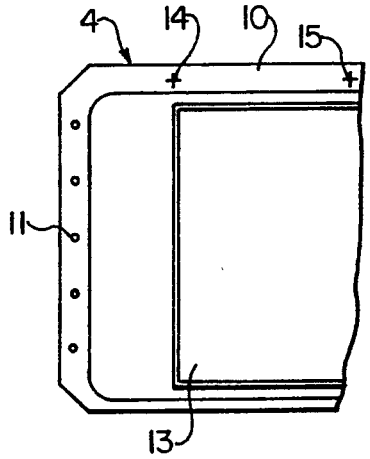
FIG. 3 shows a view of a part of a printing plate.

A printing plate 4 can be mounted on a plate cylinder 3, owing to the fact that a circumferential portion 10 of the printing plate 4 has been provided with apertures 11, see FIG. 3, both at one and the other transverse side. The apertures 11 will fall on to pins 12, mounted on the plate cylinder 3. Within the circumferential portion 10, the printing plate 4 has been provided with the printing block part 13. On a precisely defined location in relation to the printing block part 13, a marking 14 has been provided in the shape of a cross. Possibly, an additional marking 15 can be provided on the printing plate 4.

When a printing plate 4 has been mounted on all plate cylinders 3 to be used, a video camera 16 and a lamp 17 will be fitted on the offset cylinder 2. The offset cylinder 2 is now rotated to a position as indicated in FIG. 1, for example. Here, a pin 19, see also FIG. 2, can be stuck through a bore 18 in the framework 1, which pin ends up in a bore 20 in the offset cylinder 2. The offset cylinder 2 has been provided with such a bore 20 for each plate cylinder 3.

After applying the pin 19 in the bores 18 and 20, the video camera 16 can be switched on and the image obtained thereby can be observed on a monitor not illustrated. As stated above, the video camera has been provided with a reticle and by moving the plate cylinder 3 in the direction of the arrows P and R, this reticle can be made to coincide with the marking 14 on the printing plate 4.

After this has been done, the offset cylinder 2, after taking away the pin 19, can be rotated to another position and the pin 19 can be provided in another bore 20 in the offset cylinder 2. The video camera 16 will then be at the printing cylinder 3 for example, which is positioned almost at the highest point of the offset cylinder 2. There, the video camera 16 has been indicated with dash lines.

Adjustment of the plate cylinder 3 again takes place in the way described above and the operations are repeated for all plate cylinders 3.

As already discussed above, the position of the printing plate 4 on the plate cylinder 3 can be checked even further by employing the additional marking 15 on the printing plate 4. Then another additional bore 21 will be present in the framework 1.

It will be obvious, that only one possible embodiment of a device according to the invention has been illustrated in the drawing and described above and that many modifications can be made without being beyond the inventive idea.

I claim:

1. A device for printing objects, comprising:

a framework, said framework having a first bore; an offset cylinder; a plurality of plate cylinders, said plate cylinders being arranged around said offset cylinder; each of said plate cylinders having a drive shaft; rubber cloth fitted on said offset cylinder; a printing plate being fixed to each of said plate cylinders; inking means for applying ink on said printing plates and transferring the ink onto said rubber cloth; each of said plate cylinders being adjustable in axial and radial directions relative to its respective drive shaft; means for securing said offset cylinder in a plurality of positions, each of said positions corresponding to a position of a plate cylinder; each of said printing plates having images thereon, each of said printing plates having a first marking located thereon in predetermined positional relationship with said images; detecting means for detecting a positional relationship of said first markings relative to said detecting means; and wherein said detecting means is mounted on said offset cylinder.

2. Device according to claim 1, wherein said means for securing said offset cylinder comprises a plurality of bores provided in said offset cylinder, each of said bores corresponding to one of said plate cylinders, and a pin that passes through the first bore in said framework and enters one of said plurality of bores in said offset cylinder.

3. Device according to claim 1, wherein said detecting means is a video camera, said video camera having an eyepiece, said video camera having a reticle in the eyepiece of the camera, said reticle providing a means for determining relative positions of said first markings.

4. Device according to claim 1, further including lighting means for illuminating said first markings on said printing plates, said lighting means mounted adjacent said detecting means.

5. Device according to claim 1, further including a second marking on each of said printing plates, said second markings being radially spaced from said first markings, and said framework having a second bore, thereby allowing for checking of the position of the printing plates on the plate cylinders relative to the offset cylinder.

6. A device for printing objects comprising:

an offset cylinder, a plurality of plate cylinders, a plurality of printing plates, a marking provided on each of said plurality of printing plates, means for mounting each of said printing plates on one of said plurality of plate cylinders, means for positioning said offset cylinder in a predetermined position relative to one of said plurality of plate cylinders, detecting means for detecting the marking on one of the plurality of printing plates, said detecting means mounted on said offset cylinder, and means for adjusting the position of said markings relative to said detecting means by adjustment of said plate cylinders.

* * * * *